US005598179A

United States Patent [19]

Orlen et al.

[11] Patent Number: 5,598,179

[45] **Date of Patent: * Jan. 28, 1997**

[54] METHOD AND APPARATUS FOR DRIVING ELECTRONIC DISPLAYS

[75] Inventors: Noah Orlen, Boca Raton; Ali Saidi, Boynton Beach, both of Fla.

[73] Assignee: Motorola, Inc., Schaumburg, Ill.

[ * ] Notice: The term of this patent shall not extend beyond the expiration date of Pat. No. 5,459,482.

[21] Appl. No.: 75,943

[22] Filed: Jun. 14, 1993

[51] Int. Cl.[6] ..... G09G 3/36

[52] U.S. Cl. ..... 345/98; 345/94; 345/99; 345/208

[58] Field of Search ..... 345/87, 88, 89, 345/94, 95, 96, 97, 98, 99, 100, 103, 208; 359/54, 55; 382/41, 43, 281; 395/160

[56] References Cited

U.S. PATENT DOCUMENTS

| | | | |
|---|---|---|---|
| 4,952,036 | 8/1990 | Gulick et al. . | |
| 5,060,036 | 10/1991 | Choi . | |
| 5,459,482 | 10/1995 | Orlen | 345/87 |

OTHER PUBLICATIONS

Terry Scheffer and Jurgen Nehring, "Supertwisted Nematic (STN) LCDs," May 17, 1992, paper submitted to 1992 SID International Symposium, Boston, Massachusetts.

U.S. Patent Application No. 14251–43, filed May 14, 1992, by Scheffer et al., entitled "Gray Level Addressing for LCDs."

European Patent Application No. 92102353.7, filed Feb. 12, 1992, by Scheffer et al., entitled "Gray Level Addressing for LCDs."

Ruckmoncatham, "A Generalized Addressing Technique For RMS Responding Matrix $LCD_s$", 1988 International Display Research Conference, pp. 80–85.

Harmuth, "Applications of Walsh Functions in Communications", IEEE Spectrum Nov. 1969, pp. 82–91.

*Primary Examiner*—Richard Hjerpe
*Assistant Examiner*—Xiao M. Wu
*Attorney, Agent, or Firm*—Keith A. Chanroo

[57] ABSTRACT

A processing system (500) addresses an electronic display (100) comprising picture elements (pixels) (108) controlled by a plurality of first and second electrodes (106, 104). The plurality of first electrodes (106) are controlled by a plurality of periodic first drive signals (400) having a predetermined number of time slots independent of data being displayed. The plurality of second electrodes (104) are controlled by a plurality of second drive signals responsive of the data being displayed. The processing system (500) comprises calculating engine (610, 612) calculating from data being received the plurality of second drive signals for one of the plurality of second electrodes (104) for a time slot of the predetermined number of time slots. The calculating engine (610, 612) calculates one of the plurality of drive signals for the one of the plurality of second electrodes (104) as a function of the plurality of periodic first drive signals (400) for the time slot and a selected plurality of pixel values for pixels collectively controlled by the one of the plurality of second electrodes. The calculating engine (610, 612) represents the plurality of periodic first drive signals as a sequency-ordered Walsh-Hadamard transform (WHT) matrix (300) having a number of rows corresponding to the plurality of first electrodes (106) and a number of columns corresponding to the predetermined number of time slots (410–412). An identifier (510) identifies a plurality of hierarchical tree structures (Rows 1–8) corresponding to the WHT matrix (300) representation of the plurality of periodic first drive signals (400). An encoder (1504) encodes the data. A processor processes (510) the encoded data and the hierarchical tree structures (Rows 1–8) identified in the WHT matrix (300) for addressing of the pixels (108) of the electronic display (100).

12 Claims, 9 Drawing Sheets

$$\begin{bmatrix} 1 & 1 & 1 & 1 & 1 & 1 & 1 & 1 \\ 1 & 1 & 1 & 1 & -1 & -1 & -1 & -1 \\ 1 & 1 & -1 & -1 & -1 & -1 & 1 & 1 \\ 1 & 1 & -1 & -1 & 1 & 1 & -1 & -1 \\ 1 & -1 & -1 & 1 & 1 & -1 & -1 & 1 \\ 1 & -1 & -1 & 1 & -1 & 1 & 1 & -1 \\ 1 & -1 & 1 & -1 & -1 & 1 & -1 & 1 \\ 1 & -1 & 1 & -1 & 1 & -1 & 1 & -1 \end{bmatrix}$$

500

METHOD AND APPARATUS FOR DRIVING ELECTRONIC DISPLAYS

FIELD OF THE INVENTION

This invention relates in general to electronic displays and more specifically to a method and apparatus for driving electronic displays.

BACKGROUND OF THE INVENTION

An example of a direct multiplexed, root-mean-square (rms) responding electronic display is the well-known liquid crystal display (LCD). In such displays, a nematic liquid crystal material is positioned between two parallel glass plates having electrodes applied to each surface in contact with the liquid crystal material. The electrodes typically are arranged in vertical columns on one plate and horizontal rows on the other plate for driving a picture element (pixel) which are formed at the areas of overlap of each column electrode and each row electrode. A high information content display, e.g., a display used as a monitor in a portable laptop computer, requires a large number of pixels to portray arbitrary patterns of information. Matrix LCDs, for example, has 480 rows and 640 columns forming 307,200 pixels, and are widely used in computers today. Matrix LCDs with millions of pixels are expected soon.

In the so-called rms responding displays, the optical state of a pixel is substantially responsive to the square of the voltage applied to the pixel, i.e., the difference in the voltages applied to the electrodes on the opposite sides of the pixel. LCDs have an inherent time constant that characterizes the time required for the optical state of a pixel to return to an equilibrium state after the optical state has been modified by changing the voltage applied to the pixel. Recent technological advances have produced LCDs with time constants approaching the frame period used in many video displays (approximately 16.7 milliseconds). Such a short time constant allows the LCD to respond quickly and is especially advantageous for depicting motion without noticeable smearing of the displayed image.

Conventional direct multiplexed addressing methods for LCDs encounter a problem when the display time constant approaches the frame period. This problem occurs because conventional direct multiplexed addressing methods subject each pixel to a short duration "selection" pulse once per frame. The voltage level of the selection pulse is typically 7–13 times higher than the root-mean-square (rms) voltage averaged over the frame period. The optical state of a pixel in an LCD having a short time constant tends to return towards an equilibrium state between selection pulses resulting in lowered image contrast because the human eye integrates the resultant brightness transients at a perceived intermediate level. In addition, the high level of the selection pulse can cause alignment instabilities in some types of LCDs.

To overcome the above-described problems, an "active addressing" method has been developed. The active addressing method continuously drives the row electrodes with signals comprising a train of periodic pulses having a common period, T, corresponding to the frame period. The row signals are independent of the image to be displayed and preferably are orthogonal and normalized, i.e., orthonormal. The term orthogonal denotes that if the amplitude of a signal applied to one of the rows is multiplied by the amplitude of a signal applied to another one of the rows the integral of this product over the frame period is zero. The term normalized denotes that all the row signals have the same rms voltage integrated over the frame period.

During each frame period a plurality of signals for the column electrodes are calculated and generated from the collective state of the pixels in each of the columns. The column voltage at any time, t, during the frame period, T, is proportional to the sum obtained by considering each pixel in the column multiplying a "pixel value" representing the optical state (−1 representing fully "on", +1 representing fully "off", and values between −1 and +1 representing proportionally corresponding gray shades) of the pixel by the value of that pixel's row signal at time, t, and adding the products obtained thereby to the sum. If the orthonormal row signals switch between only two row voltage levels (+1 and −1), the above sum may be represented as the sum of the pixel values corresponding to rows having the first row voltage level, minus the sum of the pixel values corresponding to rows having the second row voltage level.

If driven in the active addressing manner described above, it can be shown mathematically that there is applied to each pixel of the display an rms voltage averaged over the frame period, and that the rms voltage is proportional to the pixel value for the frame. The advantage of active addressing is that it restores high contrast to the displayed image because instead of applying a single, high level selection pulse to each pixel during the frame period, active addressing applies a plurality of much lower level (2–5 times the rms voltage) selection pulses spread throughout the frame period. In addition, the much lower level of the selection pulses substantially reduces the probability of alignment instabilities.

A problem with active addressing results from the large number of calculations required per second. For example, a gray scale display having 480 rows and 640 columns, and a frame rate of 60 frames per second requires just under ten billion calculations per second. While it is of course possible with today's technology to perform calculations at that rate, the architecture proposed to date for calculation engines used for actively addressed displays have not been optimized to minimize power consumption. The power consumption and calculation speeds are issues of particularly importance to display units of portable devices which are powered by limited energy battery power supplies.

Thus, what is needed is a method and apparatus for performing calculations at high speeds while not increasing the power consumption for driving an actively addressed display.

SUMMARY OF THE INVENTION

A processing system for addressing an electronic display comprising picture elements (pixels) controlled by a plurality of first and second electrodes. The plurality of first electrodes are controlled by a plurality of periodic first drive signals having a predetermined number of time slots independent of data being displayed. The plurality of second electrodes are controlled by a plurality of second drive signals responsive of the data being displayed. The processing system comprises calculating engine for calculating from data being received the plurality of second drive signals for one of the plurality of second electrodes for a time slot of the predetermined number of time slots. The calculating engine calculates one of the plurality of drive signals for the one of the plurality of second electrodes as a function of the plurality of periodic first drive signals for the time slot and a selected plurality of pixel values for pixels collectively controlled by the one of the plurality of second electrodes. The calculating engine comprises means for representing the plurality of periodic first drive signals as a sequency-ordered Walsh-Hadamard transform (WHT) matrix having a number of rows corresponding to the plurality of first electrodes and a number of columns corresponding to the predetermined number of time slots. A means, coupled to the representing means, identifies a plurality of hierarchical tree structures corresponding to the WHT matrix representation of the plurality of periodic first drive signals. A means, coupled to the calculating engine, encodes the data. A processor, coupled to the encoding means, processes the encoded data and the hierarchical tree structures identified in the WHT matrix for addressing of the pixels of the electronic display.

A method for active addressing an electronic display comprising picture elements (pixels) controlled by a plurality of first and second electrodes. The plurality of first electrodes are controlled by a plurality of periodic first drive signals having a predetermined number of time slots independent of data being displayed. The plurality of second electrodes are controlled by a plurality of second drive signals responsive of the data to be displayed. The method comprises the steps of (a) receiving successive frames of data to be displayed; and (b) calculating, from each frame of data being received, the plurality of second drive signals for the plurality of second electrodes for a time slot of the predetermined number of time slots. The step of calculating calculates one of the plurality of second drive signals as a function of the plurality of periodic first drive signals for the time slot and a selected plurality of pixel values for pixels collectively controlled by the one of the plurality of second electrodes. The step of calculating further comprises the steps of (c) representing the plurality of periodic first drive signals as a sequency-ordered Walsh-Hadamard transform (WHT) matrix having a number of rows corresponding to the plurality of first electrodes and a number of columns corresponding to the predetermined number of time slots; (d) identifying a plurality of hierarchical tree structures corresponding to the WHT matrix representation of the plurality of periodic first drive signals; (e) encoding the frame of data being received; and (f) processing the encoded data with the corresponding hierarchical tree structures being identified in the WHT matrix for addressing the pixels of the electronic display.

DESCRIPTION OF A PREFERRED EMBODIMENT

Figure 1:
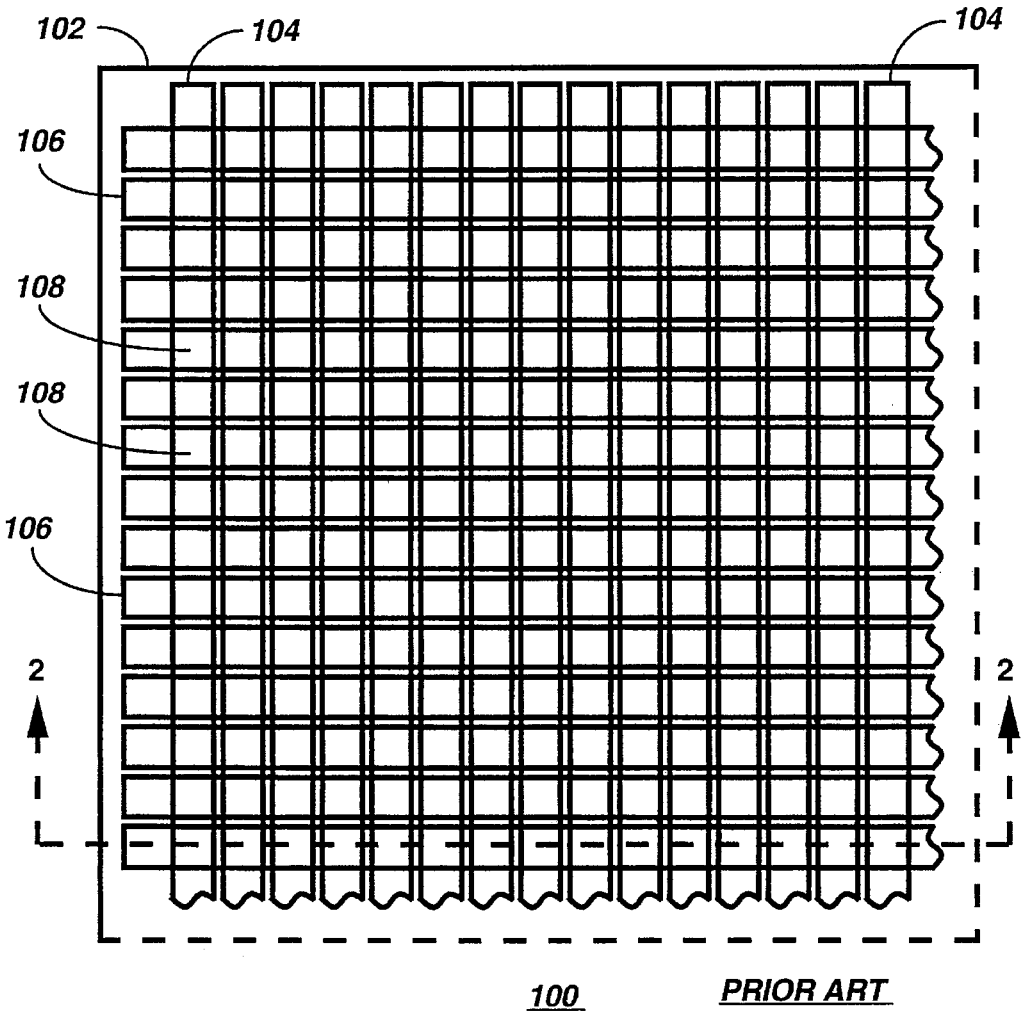
FIG. 1 is a front orthographic view of a portion of a conventional liquid crystal display.
Figure 2:
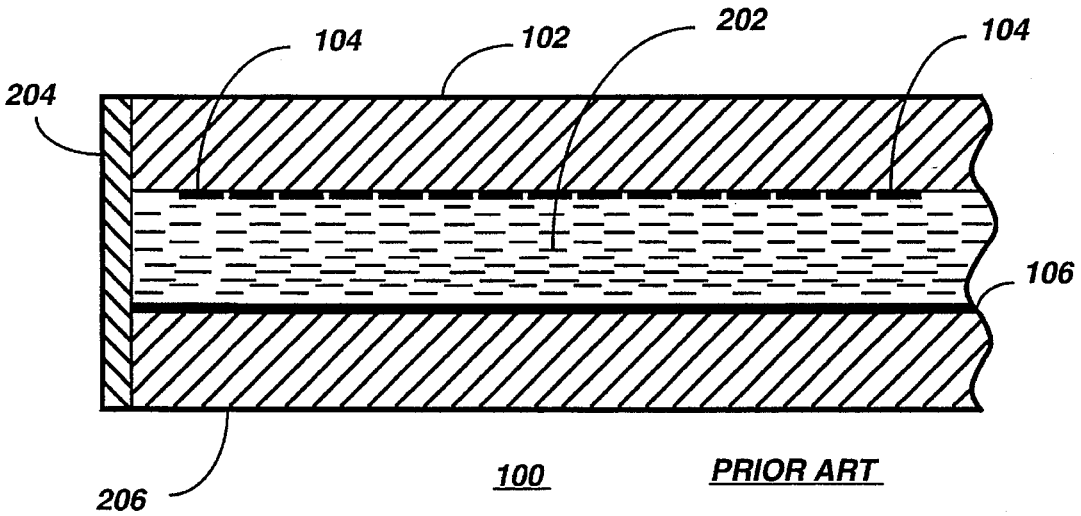
FIG. 2 is an orthographic cross-section view along the line 2—2 of FIG. 1 of the portion of the conventional liquid crystal display.

Referring to FIGS. 1 and 2, an orthographic front view and a cross-sectional view of a portion of a conventional liquid crystal display (LCD) 100 are shown depicting first and second transparent substrates 102, 206 having a space therebetween filled with a layer of liquid crystal material 202. A perimeter seal 204 prevents the liquid crystal material from escaping from the LCD 100. The LCD 100 further includes a plurality of transparent electrodes comprising row electrodes 106 positioned on the second transparent substrate 206, and column electrodes 104 positioned on the first transparent substrate 102. At the points (or areas) at which a column electrode 104 overlap a row electrode 106, herein referred to as the overlap 108, voltages applied to the electrodes 104, 106 control the optical state of the liquid crystal material 202 therebetween, thus forming a controllable picture element (pixel) defined by the overlap 108. While an LCD is the preferred display element in accordance with the preferred embodiment of the present invention, it will be appreciated that other types of display elements can be used as well, provided that such other types of display elements exhibit an optical characteristic responsive to the square of the voltage applied to each pixel, similar to the root-mean-square (rms) response of an LCD.

Figures 3, 4:
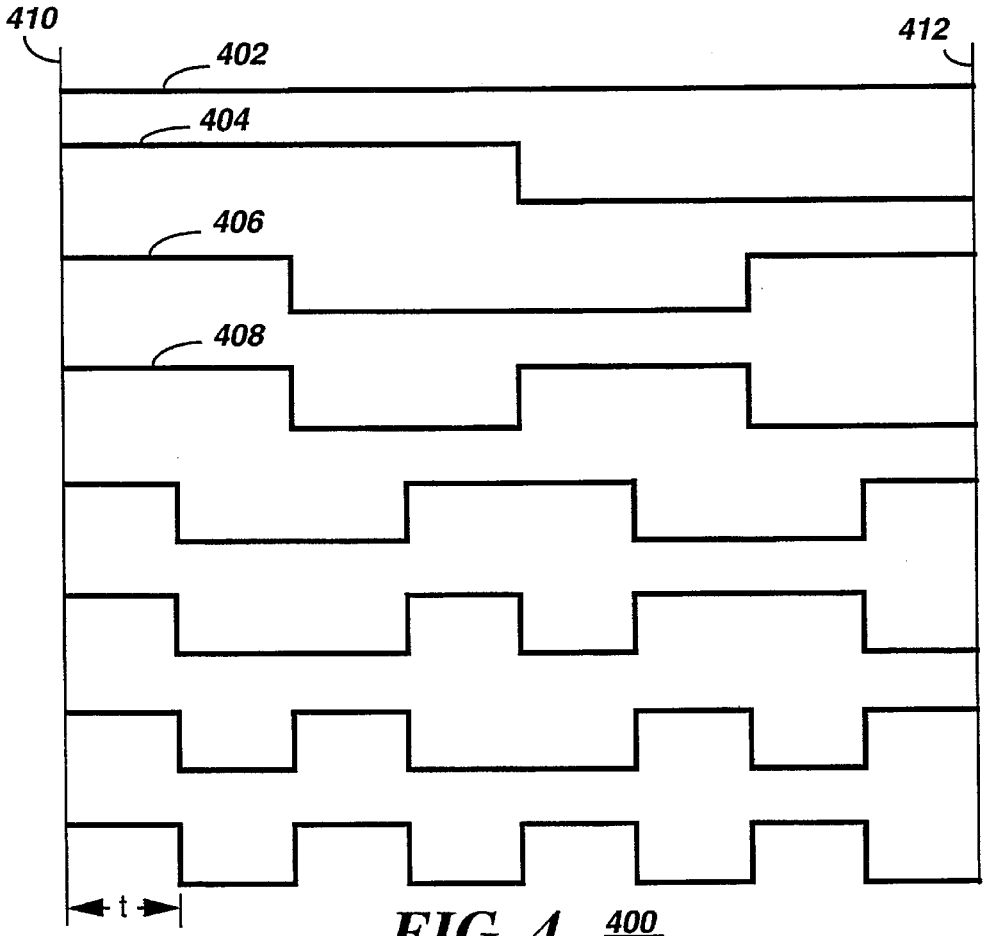
FIG. 3 is an eight-by-eight matrix of Walsh-Hadamard Transform functions in accordance with the preferred embodiment of the present invention.
FIG. 4 depicts drive signals corresponding to the Walsh-Hadamard Transform functions of FIG. 3 in accordance with the preferred embodiment of the present invention.

Referring to FIGS. 3 and 4, as an example, a representation of an eight-by-eight (third order) matrix of Walsh-Hadamard Transform matrix (hereinafter to as Walsh or WHT) functions 300 and the corresponding Walsh-Hadamard waves 400 are shown in accordance with the preferred embodiment of the present invention. Walsh transform matrix functions are orthonormal and are thus preferable for use in an actively addressed display system, as discussed above. When used in such a display system, voltages having levels represented by the Walsh waves 400 are uniquely applied to a selected plurality of electrodes of the LCD 100. For example, the Walsh waves 404, 406, and 408 could be applied to the first (uppermost), second, and third row electrodes 106, respectively, and so on. In this manner each of the Walsh waves 400 would be applied uniquely to a corresponding one of the row electrodes 106. It is preferable not to use the Walsh wave 402 in an LCD application because the Walsh wave 402 would bias the LCD with an undesirable DC voltage.

It is of interest to note that the values of the Walsh waves 400 are constant during each time slot, t. The duration of the time slot, t, for the eight Walsh waves 400 is one-eighth of the duration of one complete cycle, T, of Walsh waves 400 from start 410 to finish 412. When using Walsh waves for actively addressing a display, the duration of one complete cycle of the Walsh waves 400 is set equal to the frame duration which is the time to receive one complete set of data for controlling all the pixels 108 of the display 100.

The eight Walsh waves 400 are capable of uniquely driving up to eight row electrodes 106 (preferably, seven if the Walsh wave 402 is not used). It will be appreciated that a practical display has many more rows and columns. For example, displays having four-hundred-eighty rows and six-hundred-forty columns are widely used today in laptop computers. Walsh function matrices are available in complete sets determined by powers of two, and because the orthonormality requirement does not allow more than one electrode to be driven from each Walsh wave, a five-hundred-and-twelve by five-hundred-and-twelve ($2^9 \times 2^9$) Walsh function matrix would be required to drive a display having four-hundred-and-eighty row electrodes 106. For this case the duration of the time slot, t, is 1/512 of the frame duration. Four-hundred-and-eighty Walsh waves would be used to drive the four-hundred-and-eighty row electrodes 106 while the remaining thirty-two would be unused, preferably including the first Walsh wave 402 having a DC bias.

Figure 5:
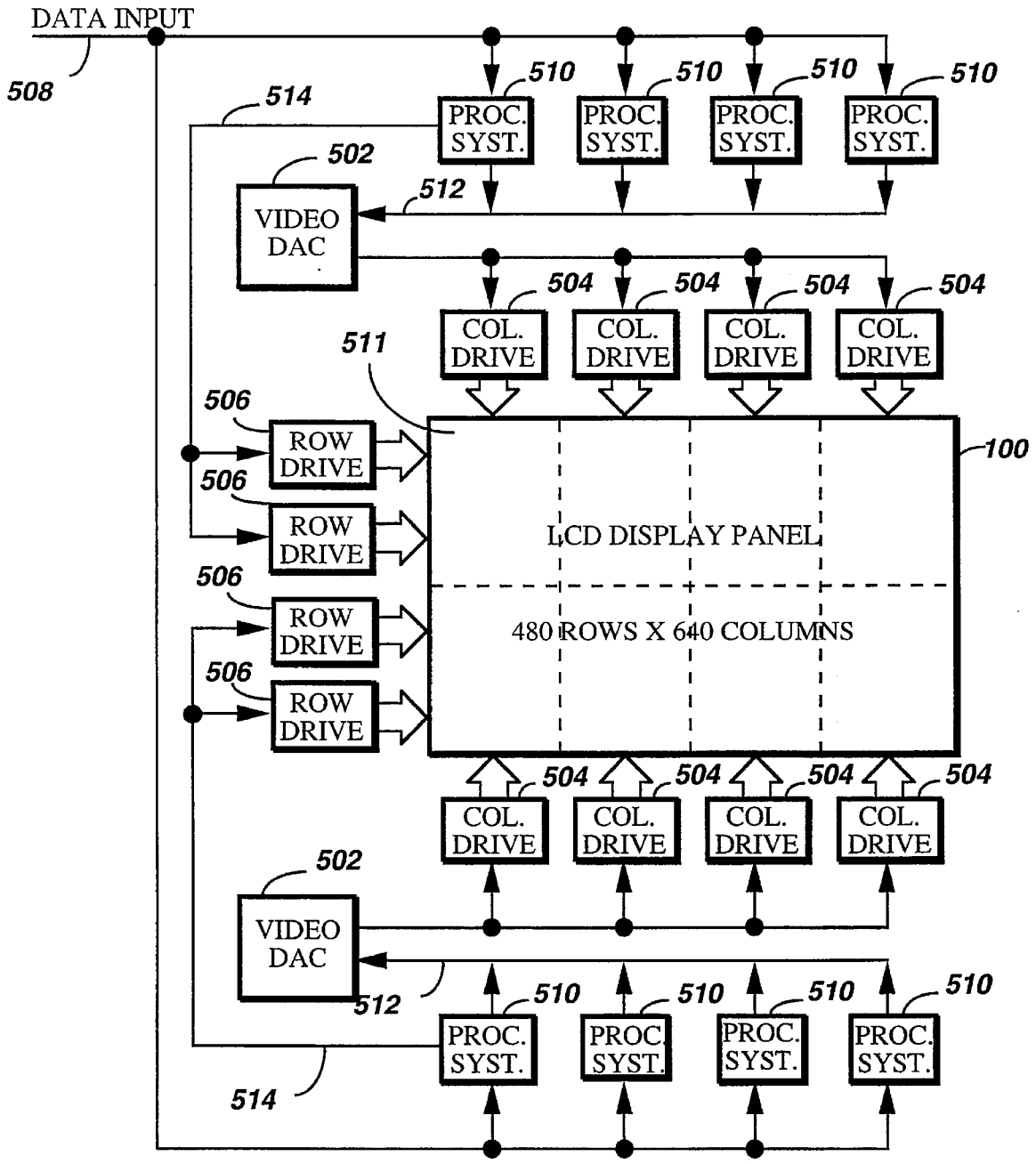
FIG. 5 is an electrical block diagram of a display system in accordance with the preferred embodiment of the present invention.

Referring to FIG. 5, an electrical block diagram of a display system 500 is shown in accordance with the preferred embodiment of the present invention. The display system 500 comprises a plurality of processing systems 510 coupled to a data input line 508, preferably eight bits wide, for receiving frames of data to be displayed. To reduce calculation requirements for each of the processing systems 510, the LCD 100 has been partitioned into eight areas 511 (illustrated by the broken lines), each serviced by one of the processing systems 510, and each containing one-hundred-sixty column electrodes 104 and two-hundred-forty row electrodes 106.

The processing systems 510 are coupled by column output lines 512, preferably eight bits wide, to video digital-to-analog converters (DACs) 502, such as the model CXD1178Q DAC manufactured by Sony Corporation, for converting the digital output signals of the processing systems 510 into corresponding analog column drive signals. The DACs 502 are coupled to column drive elements 504 of an analog type, such as the model SED1779D0A driver manufactured by Seiko Epson Corporation, for driving the column electrodes 104 (FIG. 1) of the LCD 100 with the analog column drive signals. Two of the processing systems 510 are also coupled by row output lines 514 to row drive elements 506 of a digital type, such as the model SED1704 driver also manufactured by Seiko Epson Corporation, for driving the row electrodes 106 (FIG. 1) of the upper and lower partitions of the LCD 100 with a predetermined set of Walsh waves. It will be appreciated that other similar components can be used as well for the DACs 502, the column drive elements 504, and the row drive elements 506.

The column and row drive elements 504, 506 receive and store a batch of drive level information intended for each of the column and row electrodes 104, 106 for the duration of the time slot, t, (FIG. 4). The column and row drive elements 504, 506 then substantially simultaneously apply and maintain the drive levels for each of the column and row electrodes 104, 106 in accordance with the received drive level information until a next batch, e.g., a batch corresponding to the next time slot, t, is received by the column and row drive elements 504, 506. In this manner the transitions of the drive signals for all the column and row electrodes 104, 106 occur substantially in synchronism with one another.

Figure 6:
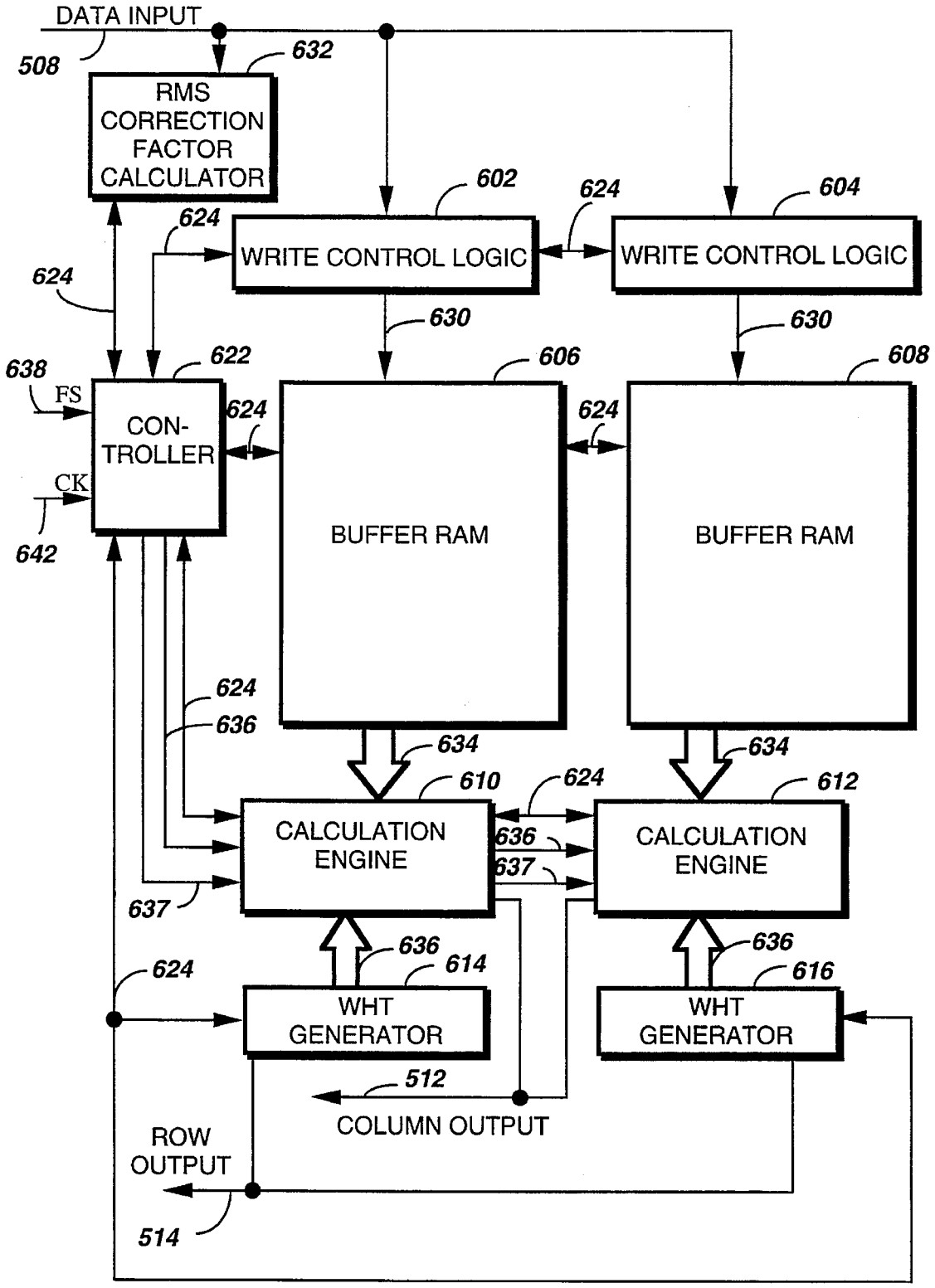
FIG. 6 is an electrical block diagram of a processing system of the display system in accordance with the preferred embodiment of the present invention.

Referring to FIG. 6, an electrical block diagram of one of the processing systems 510 of the display system is shown in accordance with the preferred embodiment of the present invention. The processing system 510 comprises the data input line 508 coupled to first and second write control logic elements 602, 604. The first and second write control logic elements 602, 604 comprise a serial-to-parallel converter, a counter, and random access memory (RAM) control logic, the operation of which are well known to one of ordinary skill in the art. The function of the first and second write control logic elements 602, 604 are to receive data comprising pixel states from the data input line 508, to convert the received data into data bytes, and to send the data bytes over the parallel busses 630 to the first and second buffer RAMs 606, 608 for storage. The data byte within the first and second buffer RAMs 606, 608 are organized by the first and second write control logic elements 602, 604 into blocks, each block corresponding to substantially all the pixels 108 controlled by a single column electrode 104 and falling within the area 511 (FIG. 5) serviced by the processing system 510.

A controller 622 is coupled by a control bus 624 to the first and second write control logic elements 602, 604 and to the first and second buffer RAMs 606, 608 for controlling their operations. The controller 622 is further coupled by the control bus 624, by a virtual value line 636, and by a first time slot line 637 to first and second calculation engines 610, 612 for controlling their operations. The controller 622 is further coupled by the control bus 624 to first and second WHT generators 614, 616 for controlling their operations also. The controller 622 is also coupled by the control bus 624 to an rms correction factor calculator 632 for controlling the rms correction factor calculator 632 and for receiving and storing correction factors calculated by and sent from the rms correction factor calculator 632. The rms correction factor calculator 632 is also coupled to the data input line 508 for monitoring the frames of data and calculating correction factors therefrom, as explained herein below in FIG. 7. A frame synchronization (sync) line 638 and a clock line 642 also are coupled to the controller 622 to provide synchronization for the controller 622. The controller 622 coordinates the operation of the first and second write control logic elements 602, 604 such that the first and second write control logic elements 602, 604 alternate in processing the frames of data received from the data input line 508. For example, the first write control logic element 602 receives a frame of data and transmits the frame of data to the first buffer RAM 606, then the second write control logic element 604 receives a next frame of data and transmits that frame of data to the second buffer RAM 608. Then the first write control logic element 602 receives a next frame of data and transmits that frame of data to the first buffer RAM 606, and so on, receiving and transmitting alternate frames of data.

The first and second buffer RAMs 606, 608 are coupled by parallel data busses 634 to first and second calculation engines 610, 612 for calculating values for driving the column electrodes 104 for each Walsh wave time slot, t. The parallel data busses 634 are sufficiently wide to transmit simultaneously pixel values for substantially all the pixels 108 controlled by a single column electrode 104 and falling within the partitioned area 511 serviced by the processing system 510. For example, in the processor 510 servicing two-hundred-forty rows and having an eight-bit pixel value, the first and second parallel data busses 634 each must have one-thousand-nine-hundred-twenty parallel paths. The structure and operation of the first and second calculation engines 610, 612 are described in greater detail herein below.

The first and second calculation engines 610, 612 are also coupled to first and second WHT generators 614, 616 by parallel transfer busses 636 for transferring the Walsh function values to the first and second calculation engines 610, 612. The parallel transfer busses 636 must be sufficiently wide to transfer a one-bit Walsh function value for each row serviced by the processing system 510. For example, in the processor 510 servicing two-hundred-forty rows, the parallel transfer busses 636 must have two-hundred-forty parallel paths. It will be appreciated that while Walsh functions are preferred, other orthonormal functions may be used as well by the first and second calculation engines 610, 612 to perform the calculations.

The function of the first and second WHT generators 614, 616 are to receive from the controller 622 the Walsh function values representation of the hierarchical tree structures, as described herein below. The first and second WHT generators 614, 616 also drive the row output line 514 with the Walsh function values corresponding to the rows serviced by the processor 510 for each time slot, t.

The controller 622 coordinates the operation of the first and second calculation engines 610, 612 and the first and second WHT generators 614, 616 such that the first and second calculation engines 610, 612 and the first and second WHT generators 614, 616 alternate in processing the frames of data read from the first and second buffer RAMs 606, 608. For example, the first calculation engine 610 and the first WHT generator 614 process a frame of data and drive the column output line 512 and the row output line 514 in accordance with the values calculated for the frame of data. Then the second calculation engine 612 and the second WHT generator 616 process the next frame of data and drive the column output line 512 and the row output line 514 in accordance with the values calculated for that next frame of data. Then the first calculation engine 610 and the first WHT generator 614 process the next frame of data and drive the column output line 512 and the row output line 514 in accordance with the values calculated for that frame of data, and so on, processing alternate frames of data.

The reason for the alternating processing taking place within the processing system 510 is so that while the first buffer RAM 606 is receiving a new frame of data, the second buffer RAM 608 can be delivering a previously received frame of data to the second calculation engine 612 for output, and vice versa. It will be appreciated that because the first and second calculation engines 610, 612 and the first and second WHT generators 614, 616 are each active only during alternate frames of data, one of the first and second calculation engines 610, 612 and one of the first and second WHT generators 614, 616 could be eliminated. This would of course require the addition of control and data routing circuitry to allow a single calculation engine to receive data alternately from both the first and second buffer RAMs 606, 608. For similar reasons, the first and second write control logic elements 602, 604 could be combined into a single write control logic element. For integrated circuit fabrication reasons, however, the preferred architecture is the fully duplicated architecture depicted in FIG. 6.

Figure 7:
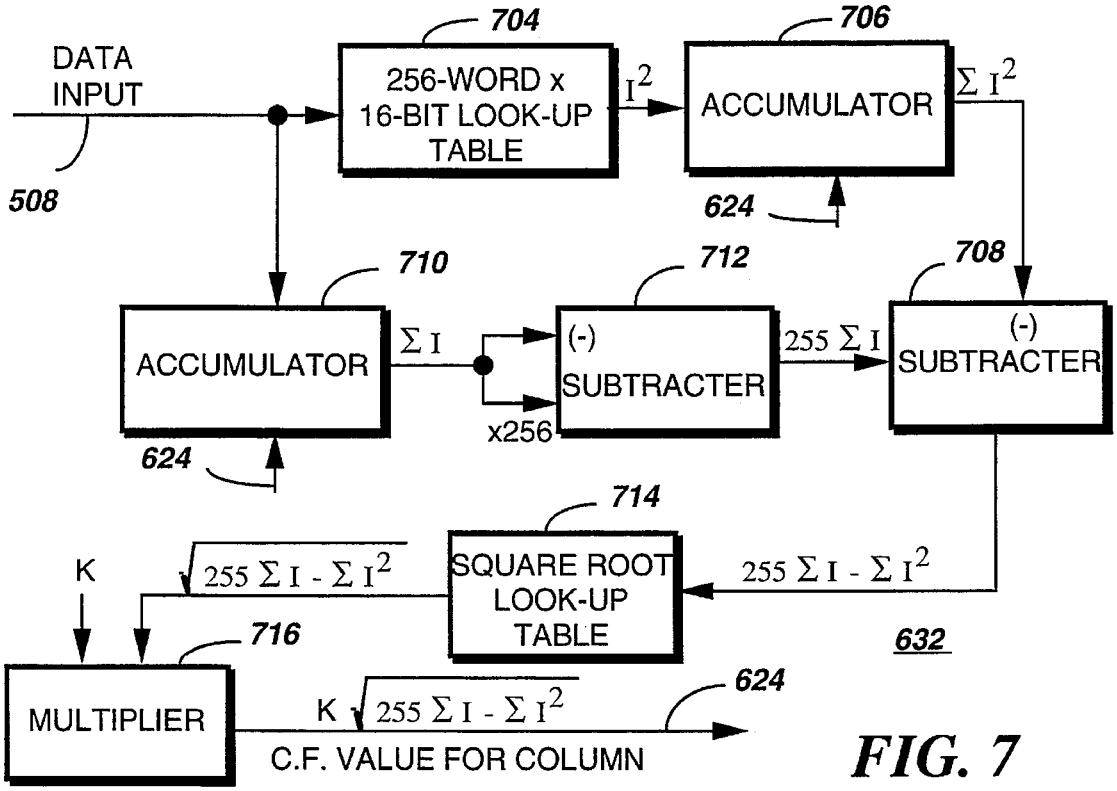
FIG. 7 is an electrical block diagram of an rms correction factor calculator of the processing system in accordance with the preferred embodiment of the present invention.

Referring to FIG. 7, an electrical block diagram of the rms correction factor calculator 632 of the processing system 510 is shown in accordance with the preferred embodiment of the present invention. The rms correction factor calculator 632 comprises the data input line 508 for receiving input and control signals, and the control bus 624 for controlling the rms correction factor calculator 632. For a display using +1 to represent a fully "off" pixel and −1 to represent a fully "on" pixel, and using Walsh functions having values of only +1 and -1, the correction factor for each column of the display is $$\frac{1}{\sqrt{N}}\sqrt{N-\sum_{i=1}^{N} I_i^2}\ , \tag{1}$$

where N is the number of real rows, and $I_i$ is the pixel value for the ith row of the column.

Adjusting for eight-bit pixel values having a range of 0–255, and assuming there are two-hundred-forty real rows, equation (1) becomes $$\frac{1}{\sqrt{240}}\sqrt{240-\sum_{i=1}^{240}\left(\frac{I_i-127.5}{127.5}\right)^2}\ , \tag{2}$$

which simplifies to $$\frac{1}{127.5\sqrt{240}}\sqrt{255\sum_{i=1}^{240} I_i-\sum_{i=1}^{240} I_i^2}\ , \tag{3}$$

which simplifies further to $$\frac{\sqrt{255\sum_{i=1}^{240} I_i-\sum_{i=1}^{240} I_i^2}}{1975}\ . \tag{4}$$

It is the function of the rms correction factor calculator 632 to calculate this correction factor for each column from the data arriving over the data input 508.

The rms correction factor calculator 632 further comprises a first accumulator 710 coupled to the data input line 508 for summing the pixel values received. The output of the first accumulator 710 is coupled to both inputs of a first subtracter 712, wherein the minuend input data is first shifted eight bits to the left to multiply the minuend input data by two-hundred-fifty-six, thus producing an output value of 255 Σ I.

The data input line 508 is also coupled to the input of a first look-up table element 704 for determining the square of the pixel value. The output of the first look-up table element 704 is coupled to the input of a second accumulator 706 for summing the squares of the pixel values. The output of the second accumulator 706 is coupled to the subtrahend input of a second subtracter 708, to which the output of the first subtracter 712 is coupled at the minuend input for obtaining the difference 255 $\Sigma I-\Sigma I^2$. The output of the second subtracter 708 is coupled to a second look-up table element 714 for determining the square root value $\pm\sqrt{255\Sigma I-\Sigma I^2}$.

Figure 8:
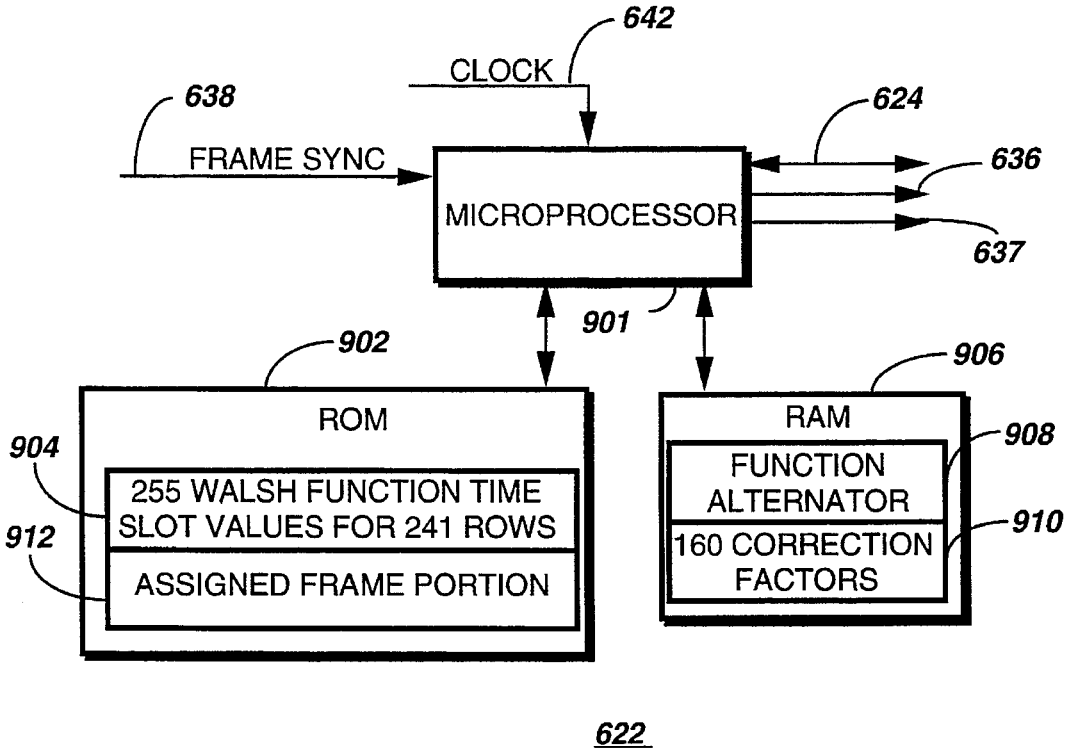
FIG. 8 is an electrical block diagram of a controller of the processing system in accordance with the preferred embodiment of the present invention.

The output of the second look-up table element 714 is coupled to an input of a multiplier element 716. The other input of the multiplier element 716 is preprogrammed for a constant value K. The value of K provides for the division factor of 1975 from equation (4), as well as any other drive level adjustments that may be required for the LCD 100. The output of the multiplier element 716 is coupled by the control bus 624 to the controller 622 for storing the calculated correction factor. It will be appreciated that an arithmetic logic unit or a microcomputer can be substituted for some or all of the first and second look-up table elements 704, 714 and the multiplier element 716. It will be further appreciated that a microcomputer can also replace all the elements of the rms correction factor calculator 632. Referring to FIG. 8, an electrical block diagram of the controller 622 of the processing system 510 is shown in accordance with the preferred embodiment of the present invention. The controller 622 comprises a microprocessor 901 coupled to a read-only memory (ROM) 902 containing operating system software. The ROM 902 further contains predetermined Walsh function values 904, e.g., two-hundred-fifty-six time slot values for each of the two-hundred-forty real row electrodes 106, plus one virtual row. The ROM 902 also has been pre-programmed with an assigned frame portion value 912 indicating the portion of the frame of data, e.g., the portion of the display that the processing system 510 comprising the controller 622 is assigned to process. The microprocessor 901 is also coupled to a random access memory (RAM) 906 comprising a location for storing a function alternator 908 for alternating the functions of elements of the processing system 510, as described herein above. The RAM 906 further comprises a location for storing one-hundred-sixty column correction factors 910 received from the rms correction factor calculator 632 over the control bus 624. The microprocessor 901 is further coupled to the frame sync line 638 and to the clock line 642 for receiving frame sync and clock signals, respectively, from a source of the frames of data, e.g., a processor of a personal computer. The microprocessor 901 is coupled to the processing system 510 by the control bus 624, the virtual value line 636, and the first time slot line 637 for controlling the processing system 510.

Figure 9:
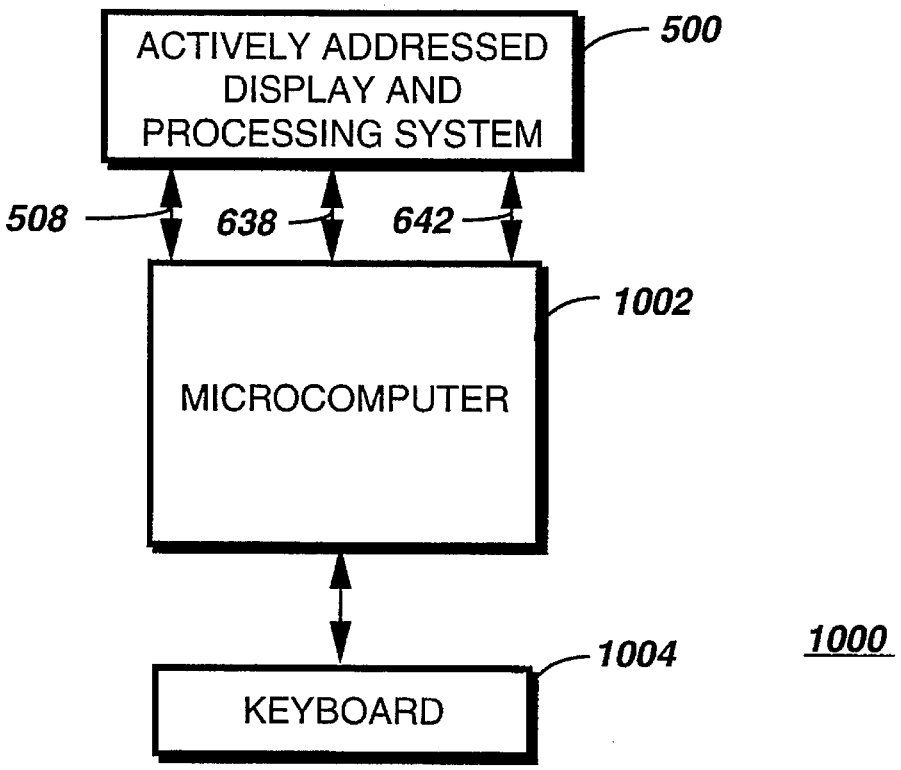
FIG. 9 is an electrical block diagram of a personal computer in accordance with the preferred embodiment of the present invention.

Referring to FIG. 9, an electrical block diagram of a personal computer 1000 in accordance with the preferred embodiment of the present invention comprises the display system 500 coupled to a microcomputer 1002 by the data input line 508 for receiving frames of data from the microcomputer 1002. The display system 500 is further coupled to the microcomputer 1002 by the frame sync line 638 and the clock line 642 for receiving frame sync and clock, from the microcomputer 1002. The microcomputer 1002 is coupled to an input device, for example a keyboard 1004, for receiving inputs from a user.

Figure 10:
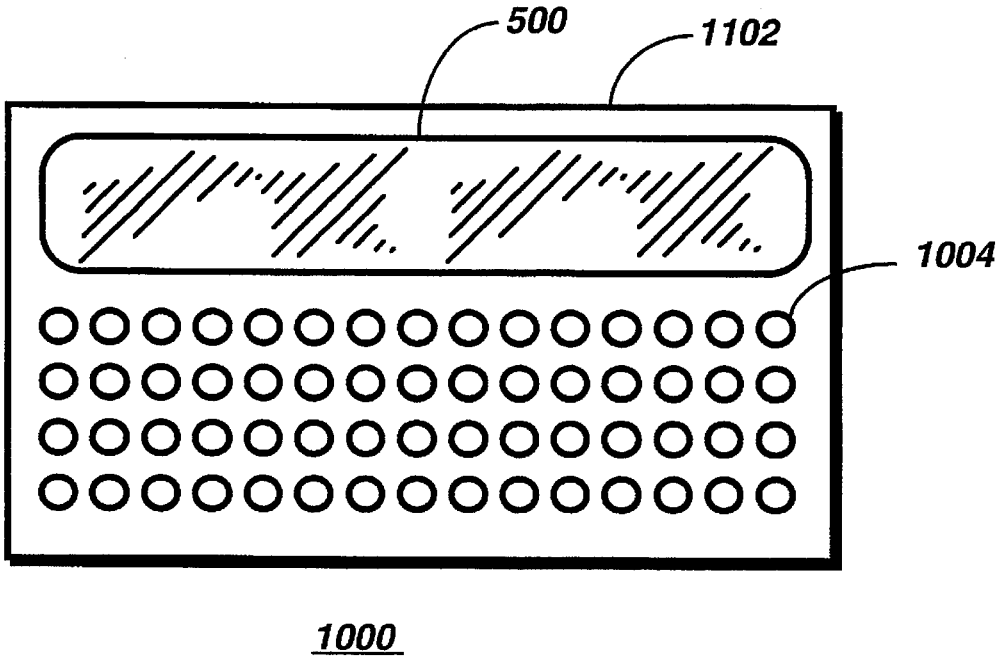
FIG. 10 is a front orthographic view of the personal computer in accordance with the preferred embodiment of the present invention.

Referring to FIG. 10, a front orthographic view of the personal computer 1000 is shown in accordance with the preferred embodiment of the present invention illustrating the display system 500 supported and protected by a housing 1102. The keyboard 1004 is also illustrated. Personal computers, such as the personal computer 1000, often are constructed as portable, battery-powered units. The display system 500 is particularly advantageous in such battery-powered units, because the reduced calculation rate of the processing system 510 of the display system 500 compared to conventional processing systems for actively addressed displays greatly reduces the power consumption, thus extending the battery life.

For the purpose of discussing the operation of the display system 500, it is necessary to define some terms. The term "first processor", as used herein below, refers to a first portion of the plurality of processing systems 510. The first portion collectively comprises the first write control logic elements 602, the first buffer RAMs 606, the first calculation engines 610, and the first WHT generators 614 of the plurality of processing systems 510. The term "second processor", as used herein below, refers to a second portion of the plurality of processing systems 510. The second portion collectively comprises the second write control logic elements 604, the second buffer RAMs 608, the second calculation engines 612, and the second WHT generators 616, of the plurality of processing systems 510. The rms correction factor calculators 632 and the controllers 622 collectively are common to both the first and second processors.

System operation is such that when frame sync is received, each controller 622 of the plurality of processing systems 510 determines from the assigned frame portion value 912 which portion of the frame of data the processing system 510 that comprises the controller 622 is assigned to process. The controller 622 then delays the start of processing by the corresponding processing system 510 until the frame of data reaches the assigned portion. The controller 622 also accesses the function alternator 908 to control the alternation of processing functions between the first and second processor.

Figure 11:
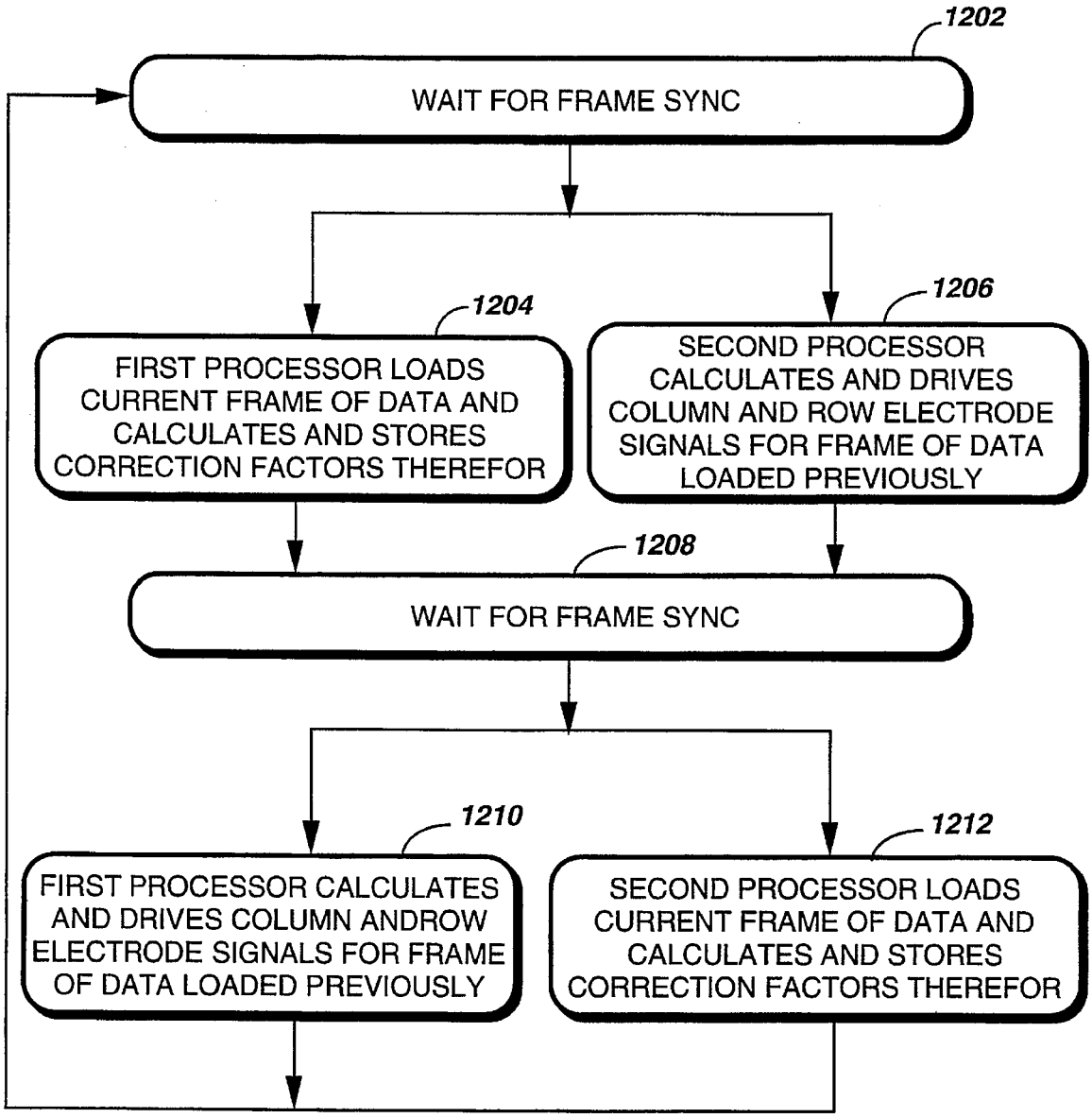
FIG. 11 is a flow diagram illustrating the operation of the display system in accordance with the preferred embodiment of the present invention.

Referring to FIG. 11, a flow diagram illustrating the operation of the display system 500 in accordance with the preferred embodiment of the present invention begins with the controllers 622 of the first and second processors waiting 1202 for frame sync. When frame sync arrives, the first processor loads 1204 the current frame of data while the rms correction factor calculators 632 calculate the column correction factors for the portion of the frame of data assigned to the respective processing systems 510 corresponding to each of the rms correction factor calculators 632. This is followed by the storing of the calculated column correction factors by the controllers 622 in the RAM 906 at the location for storing column correction factors 910.

Meanwhile, the second processor concurrently calculates 1206 in the second calculation engines 612 the column signals using Walsh function representation of the hierarchical tree structures supplied to the second WHT generators 616 by the controllers 622. The second processor then drives the column output line 512 and the row output line 514 with the calculated column signals and the Walsh function values, respectively. The controllers 622 coordinate the processing systems 510 to calculate and drive the column and row output lines 512, 514 at the correct times corresponding to their respective portions of the frames of data.

Next, the first and second processors again wait 1208 for frame sync. When frame sync arrives, the first processor calculates 1210 in the first calculation engines 610 the column signals using Walsh function representation of the hierarchical tree structures supplied to the first WHT generators 614 by the controllers 622. The first processor then drives the column output line 512 and the row output line 514 with the calculated column signals and the Walsh function values, respectively. The controllers 622 coordinate the processing systems 510 to calculate and drive the column and row output lines 512, 514 at the correct times corresponding to their respective portions of the frames of data.

Meanwhile, the second processor concurrently loads 1212 the current frame of data while the rms correction factor calculators 632 calculate the column correction factors for the portion of the frame of data assigned to the respective processing systems 510 corresponding to each of the rms correction factor calculators 632. This is followed by the storing of the calculated column correction factors by the controllers 622 in the RAM 906 at the location for storing column correction factors 910. The flow then returns to step 1202, and the process repeats.

By alternately loading the first and second buffer RAMs 606, 608 with a full frame of data before processing the frame of data in the processing systems 510, the display system 500 advantageously allows the data to be processed in parallel, thereby significantly reducing the calculation rate, e.g., by a factor of two-hundred-forty, compared to conventional actively addressed display systems. By further dividing the LCD 100 into the eight areas 511 for processing as described herein above, the processing load is reduced by an additional factor of eight. Thus, the processing systems 510 are able to operate at a clock rate of approximately two and one-half MHz. The reduction in the calculation rate significantly reduces the power consumption of the display system 500, thus enabling substantially improved battery life in a portable electronic device that includes the display system 500.

The preceding discussion and analysis of the preferred embodiment of the present invention apply to pixel values represented by eight-bit data. It will be appreciated that the present invention can be adjusted to accommodate pixel values represented by both larger and smaller numbers of bits, e.g., sixteen-bit pixels or four-bit pixels.

Active-addressing involves, generally, a multiplication of the image matrix with the row matrix (Walsh row signals) to obtain the column signal matrix for driving the column electrodes of the LCD. The row signals are used to calculate the column signal matrix, as discussed above, and also to drive the row electrodes of the LCD. One method of generating the column signal matrix is to generate the column matrix column-wise by multiplying each column of the image data with all rows of the row matrix. A second method of generating the column signal matrix is to generate the column matrix row-wise. This is done by multiplying each row of the image data with all columns the row matrix. A third method of generating the column signal matrix according to the preferred embodiment of the present invention is by the use of a hierarchical tree (hidden-tree) structures technique. With the hierarchical tree structures technique, to be discussed in detail below, it is possible to generate the column signal matrix both row-wise or column-wise.

The WHT kernel illustrated in FIG. 3 is used to represent the signal amplitude applied to the row electrodes of the display system (electronic display) and to compute the column drive signals for driving the column electrodes of the display system. The WHT kernel has a number of unique properties that provide a method for identifying and utilizing the hierarchical tree structure by re-representing, for example, the row signals of the WHT kernel. This re-representation, to be discussed below, facilitates the hierarchical description of the WHT kernel which presents an opportunity for considerable reduction in the power consumption requirements of the calculation engines because the hierarchical description of the hidden-tree technique reduces the number of calculations performed for a given display system to generate the column signal matrix as compared with the available techniques.

Figure 12:
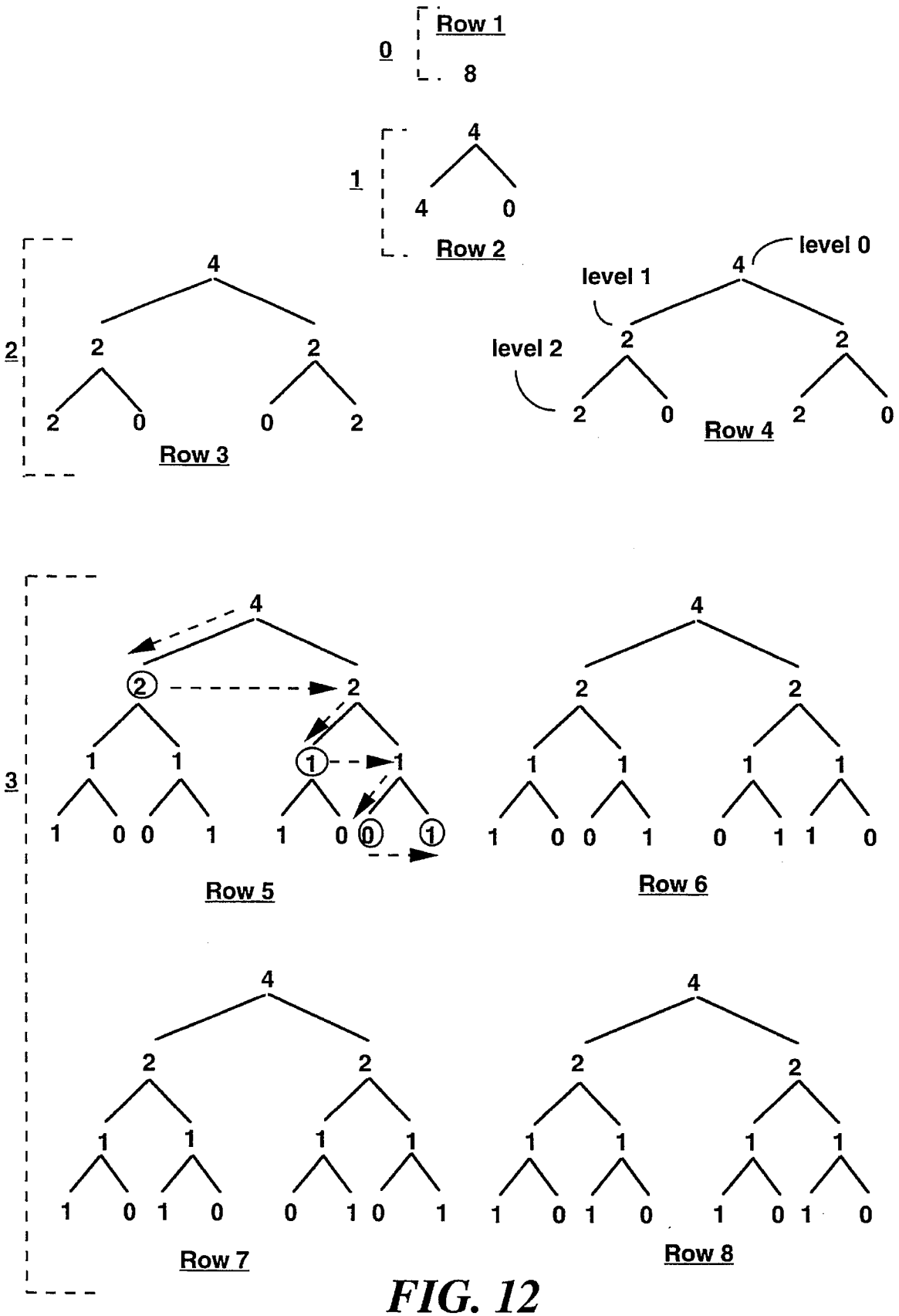
FIG. 12 is a series of hierarchical tree structures illustrating the re-representation of the WHT matrix in accordance with the preferred embodiment of the present invention.

Referring to FIG. 12, a series of hierarchical tree diagrams illustrating a pictorial view of the re-representation of the WHT matrix in accordance with the preferred embodiment of the present invention are shown. Preferably, each row of the WHT matrix, shown in FIG. 3, is represented as a hierarchical tree structure, rows 1–8, of an 8×8 matrix. The value at each node (level) of the identified hierarchical tree structure represents the number of "ones" in a given subset of the tree, the sibling value. For example, row 1 shows the number eight (8), the sibling value, which specifies that there are eight "ones" in that row out of eight elements (for an 8×8 matrix). At this level of row 1 any further branching is meaningless because all the elements of a column of data can be determined at that level (the first level). Referring to row 2, the first level shows a sibling value of four (4) which represents four (4) "ones" out of eight elements (the codeword size). At the next lower level (sub-level) of row 2, the eight elements are divided equally among two branches, the first branch has a sibling value of four "ones" out of four elements and the other branch has a sibling value of zero "ones" out of four elements, that is also equivalent to four "minus ones" out of four elements. As shown in FIG. 3, there are an even and equal numbers of "ones" and "minus ones" in each row of the Walsh transform matrix. Further reference to row 4 shows a sibling value of four (4) "ones" out of the eight elements codeword size at the first node (first level), level 0. Continuing down the tree structure, the first branch of the second level, level 1, shows a sibling value of two (2) "ones" out of four elements. The second branch of the second level, level 1, shows a sibling value of two (2) "ones" out of the other four elements. Continuing down to the third level, level 2, the first branch at the node above is divided again, and the first branch of the third node, node 2, shows a sibling value of two (2) "ones", and the adjacent branch shows a sibling value of zero "ones". Moving across to the next branch, the first sub-branch shows a sibling value representing two "ones" and the second sub-branch shows a sibling value representing zero "ones". The "variant" is the last level of the tree, and it is the level at which further division is meaningless because all eight elements can be generated from the knowledge at that level. Accordingly, the last level, level 2, (the variant level) is read as two of the two elements are "ones", zero of two elements are "ones" (or two of two elements are "minus ones"); and two of the two elements are "ones", zero of two elements are "ones".

Additionally, the eight binary trees have been categorized into four groups 0, 1, 2, 3. Each group defines a base group. For example, group 3 of FIG. 12 has four binary tree structures each having four levels. Each tree is equivalent to each other except at the last level (the variant level). The base tree for that group is defined as having only the first three levels that are identical to each other. The last level represents one of the four possible variants. A similar representation can be given for group 2, however, group 2 has a base tree equal to the first two levels of the tree structures, e.g., two variant groups.

Therefore, by representing each rows of the WHT matrix as the hidden tree structures as described, it will be illustrated that there are redundancies inherent in the description of the WHT matrix which can be exploited to reduce the computation burden on the calculation engines thereby reducing their power consumption. Accordingly, a mathematical representation of the construction and utilization of the hidden tree structures for an arbitrary N-by-N (N×N) Sequency-Ordered WHT kernel will be developed below to reduce the computational burden placed on the calculation engines by eliminating the redundancies which will reduce the power consumption. This reduction in computation burden can, on the other hand, increase computational speed for a display system with the same calculation engines because, with the WHT hierarchical tree structure method, the calculation engines perform fewer numbers of calculations for the same addressing requirement.

In this way, the same calculation engines are able to process the same image data for the same display system, under certain conditions, achieving a reduction in the number of calculations that can reach and surpass seventy-eight percent (78%) less that the existing technique (or method) currently being used. Therefore, with the hierarchical tree representation, the same calculation engines are capable of achieving significant increases in the number of pixels being addressed which will produce a substantial increase in the resolution of the display systems while maintaining the same power consumption of the portable devices.

The image data is represented as an N×N matrix, where N is an integer in accordance with the preferred embodiment of the present invention. An N×N Walsh-Hadamard Transform matrix is required for the row signals' matrix. The column matrix, $Gj(\Delta t_k)$, in its most basic form can be represented as the number of matches, $Dj(\Delta t_k)$ between Jth column of the image data matrix and the corresponding elements in the $k_{th}$ row of the WHT matrix for the address computation which is illustrated below as:

$$Gj(\Delta t_k)=(F/\sqrt{N})\times(2Dj(\Delta t_k)-N) \quad (5)$$

where:

$Dj(\Delta t_k)$ are the number of matches between the Jth column of the image data matrix and the corresponding elements in the $k_{th}$ column of the row addressing function;

$\Delta t_k$ represents the kth element in of the column matrix; and

F is a constant.

The N×N matrix results in a kernel size of:

$$2^{[\log_2 N]}\times 2^{[\log_2 N]} \quad (6)$$

for performing the transformation, where $^{\log_2 N}$ represents the largest integer.

In constructing and using the hierarchical tree model for the N×N transform kernel, the maximum Depth of the tree is represented as:

$$\text{Depth}={}^{\log_2 N} \quad (7)$$

and the maximum number of base trees (Group) is represented as:

$$Group=1+{}^{\log_2 N}=1+Depth \quad (8)$$

where the Group varies within the set of $\{0 \text{ to } {}^{\log_2 N}\}$.

The maximum number of levels of the tree structure is represented as the number of levels (the base tree level). The number of levels may be one of the set of {0, 1, . . . , Group}.

The codeword size belongs to a set comprising:

$$\{2^{depth}, 2^{depth-1}, \ldots, 2^{depth-group}\}$$

and is given as:

$$\text{Codeword size(level)}=2^{depth-level}. \quad (9)$$

According to the preferred embodiment of the present invention, the image data is preferably received column-wise, and the columns of the image data are run length encoded (RLE). The value of each codeword of the run length encoded (RLE) data determines how far down the tree (number of levels) is to be traversed based on the following rule:

for a Group within the set of {0, 1, 2, . . . , depth}, see Table 1.

Table 1 below illustrates the rule for determining the desired position (the level) within a given tree based on the RLE data.

TABLE 1

| Level | corresponding Run |
|---|---|
| Length | |
| 0 | $RLE = 2^{depth}$ |
| 1 | $2^{depth} > RLE \geqq 2^{depth-1}$ |

TABLE 1-continued

| Level | corresponding Run |
|---|---|
| 2 | $2^{depth-1} > RLE \geqq 2^{depth-2}$ |
| 3 | $2^{depth-2} > RLE \geqq 2^{depth-3}$ |
| . | |
| . | |
| . | |
| Group | $2^{depth-group} \geqq RLE.$ |

Figure 13:
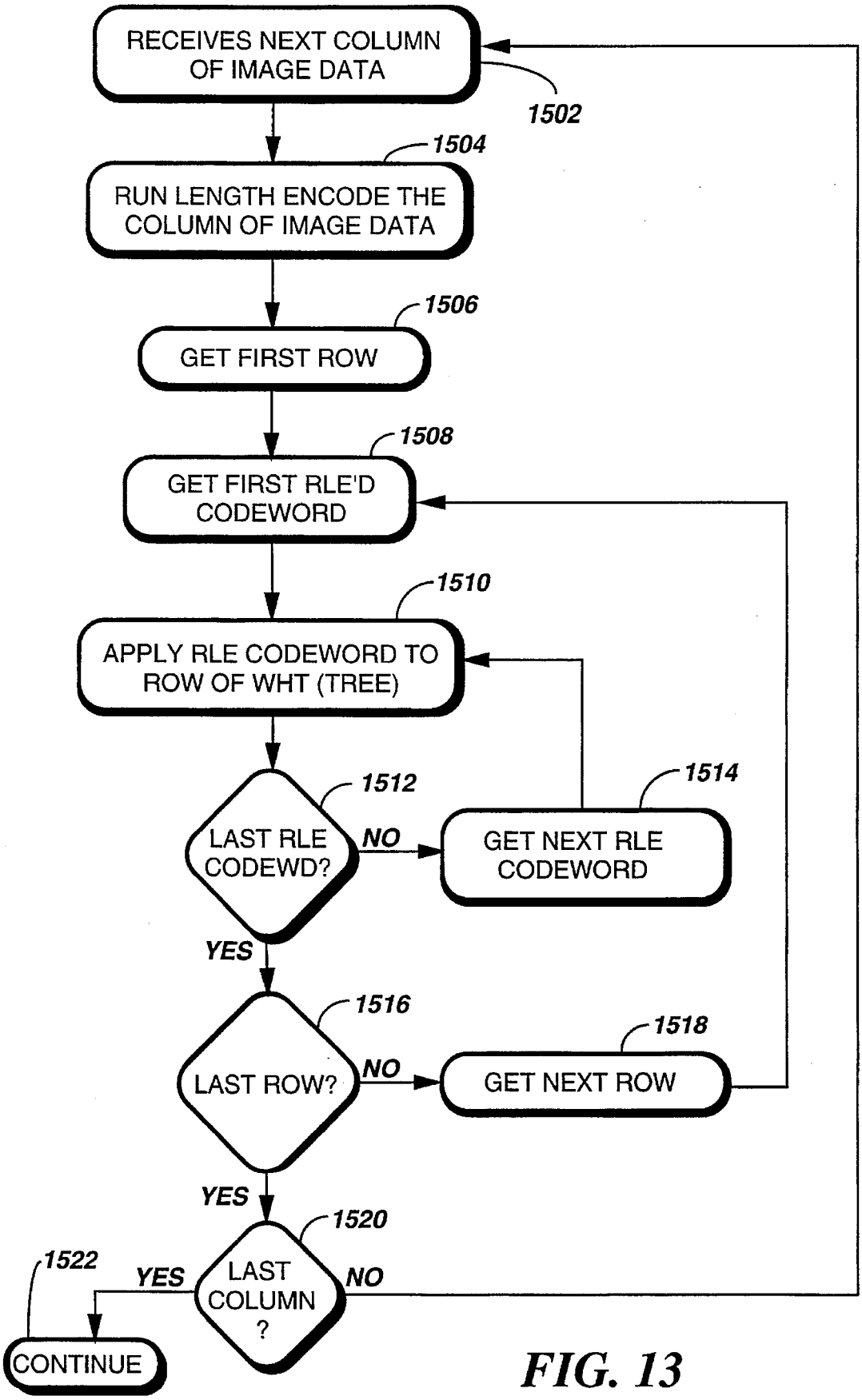
FIG. 13 is a flow diagram illustrating the processing systems for actively addressing electronic displays using the hierarchical tree structures in accordance with the preferred embodiment of the present invention.

A description of the active addressing is accomplished by applying the above equation with reference to FIG. 13, a flow diagram illustrating the processing systems for actively addressing electronic displays using the hierarchical tree structures in accordance with the preferred embodiment of the present invention. The image data is, for example, arranged in the matrix form and preferably received in columns of the represented matrix, step 1502. An encoder encodes the columns of received data, preferably, run-length-encoded (RLE), step 1504. An example of the preferred RLE technique, when the column of data corresponds to "+1 +1 +1 −1 −1 +1 −1 −1", then the run length encoded codeword is "3 2 1 2". The first number "3" corresponds to the first three "+1s", the second number "2" corresponds to the two "−1s", the third number "1" corresponds to the one "+1", and the last number "2" corresponds to the two "−1s". From this column of image data, as illustrated, four RLE codewords are derived. The first tree structure is identified, preferably from the second row of the WHT matrix, step 1506. According to the preferred embodiment of the present invention, row 2 of FIG. 12 is used because row 1 (all "ones") produces a direct current (DC) level which is undesirable. The step of identifying a given hierarchical tree structure comprises selecting a row of the WHT matrix, because according to the preferred embodiment, each hierarchical tree structure being identified is identified from each row of the WHT matrix. With the selected row, the group of the tree is determined from equation (8), and then the number of variants are determined which is shown by equation (10) given below. Both the group and the variant number (e.g., the specific variant within the group) can be determined from the selected row of the WHT matrix. These two values (group and variant) provide all information necessary for identifying the tree. Notwithstanding the description for identifying the hierarchical tree structures, the number of levels being identified in each instance depends on the image data because different numbers of sub levels are needed depending on the image data being processed. Simultaneously with the identification of the hierarchical tree structures, the first RLE codeword of the image data is retrieved, step 1508, for example, codeword "3", and applied to the Group and variant that were determined from tree that is being identified, step 1510. The details of step 1510 will be discussed below. As discussed in the description to FIG. 12, it was noted that each Group has at least one variant which is a function of the Group. The number of variants can be represented as:

$$\text{Variant(group)}=2^{group-1} \quad (10)$$

TABLE 2

| Group | Number of Variants |
|---|---|
| 1 | $2^{group-1} = 1$ |
| 2 | $2^{group-1} = 2$ |
| . | . |
| . | . |

TABLE 2-continued

| Group | Number of Variants |
|---|---|
| . | . |
| $\log_2 N$ | $2\log_2 N-1$ |

Also, the variants need not to be generated in all instances. It is necessary to generate a variant of a given group based on the following equation:

$$RLE \leqq 2^{depth-group}. \quad (11)$$

In generation of the variant, the sequency-ordered WHT kernel is generated as:

$$2^{Group} \times 2^{Group}$$

and the variant is given as row number:

$$2^{Group}/2+Offset \quad (12)$$

where Offset is the given variant number in the specific base group. For example, a "1" corresponds to $2^{depth-group}$ "+1s" and zero corresponds to "−1s", a "−1" is therefore represented as $2^{depth - group}$ "−1s" and zero "+1s". The preceding equations and rules provide all the necessary information for formalizing the hierarchical tree model.

Traversing down a given tree provides added resolution, and the image data dictates the required resolution which in turn dictates how far to traverse down the tree. For example, if column four of the image data has a "run" (value) of eight "+1s", then referring to row 4 of FIG. 12, for example, it is seen that by correlating the RLE data with the first level (derived from the Group and variant numbers) that it is not necessary to traverse down any levels in the tree, because the desired information can be obtained from level zero which results in four matches for that column of data. With this image data, the calculation engine would be required to do zero (0) additions while identifying only the first node of the first level of the hierarchical tree structure.

By way of illustration, assume that column 5 of the 8×8 matrix has an image data of "1 1 1 1 0 0 0 1", then the run-length codeword is "4 3 1". With the tree identified at row 5 which has a group 3 number from equation (8) (see FIG. 12). The number of variants are determined from equation (10) to be four (4) which is also shown in FIG. 12. The variant number for row 5 is one, e.g., the first variant in group three. The first RLE codeword is retrieved "4" (four "+1s"), and at node (level) 0 of row 5, a determination whether to perform a correlation will be made in reference to Table 1, at level 0. The number of matches are determined by correlating the run-length codeword with the sibling value at each successive sub-level to determine when the value of the RLE codeword satisfies the equations at the corresponding levels of Table 1. Therefore, since the RLE codeword is "4", this value does not satisfy level 0 of Table 1, because it is not equal to eight so no correlation is performed at level 0. It is therefore necessary to traverse one level down the tree, and at level 1, the RLE "4" satisfies the equation at level 1 of Table 1. Specifically, $2^{depth} > RLE \geqq 2^{depth-1}$ at level 1 equates to ($8>4\geqq4$). Since the condition is satisfied at level 1, level 1 is generated and a correlation is performed with the sibling values (values) at level 1 with the RLE codeword. The sibling values (values) are generated from the knowledge of the properties of the WHT matrix and the level number of the hierarchical tree structure. As was discussed, each row of the WHT matrix has its particular row value, and at each sub-level, the row valves are divided equally to generate the sibling values. By correlating the codeword of the image data with sibling value at level 1, the numbers of matches are determined to be two ( two "+1s") at level 1 for the first codeword "4". The next codeword "3" (three "−1s") is then selected. In proceeding to determine the number of matches, it is to be noted that the position in the tree in not memoryless. It is a function of the past as well as the current run length codeword. All past runs for a given column of image data will determine the next position in the tree for the current run length codeword. This is easily understood because for each column, for example, the run length encoded image data can produce more than one run-length-encoded codeword. Therefore, each subsequent RLE codeword being processed is affected by the position of the previous codeword in the column of image data.

Therefore, with the second RLE "3", it is necessary to shift to the next branch (the next sibling value) at the same level, level 1, of the tree (row 5). The RLE of "3" does not satisfy the equation in Table 1 at level 1 so no correlation is performed at this level. Accordingly, it is necessary to traverse down the tree as shown by the broken arrow. At level 2, referring to Table 1 at level 2, the RLE "3" satisfies the equation at level 2 because three is between four and two as required by the equation at level 2. This sub-level is generated and the sibling values are determined. The numbers of matches are then determined by the step of correlating which correlates the sibling value with the RLE codeword resulting in one match (one "−1"). At this juncture, there is a total of three n-matches (two "+1s" and one "−1"). A remainder of one (one "−1") is left from the second RLE codeword because only two of the three value were used to obtain the single match. At level 2, the remainder "1" does not satisfy the equation of Table 1, level 2 so no correlation is performed at this level. It is therefore necessary to traverse down to level 3 as shown by the broken line in FIG. 12, row 5. At level 3, the equation in table 1, level 3 is satisfied, and this sub-level is generated and sibling values are determined. A correlation is performed with the remainder one ("−1") and the first sibling value at level 3 which produces a match. At this point, there are a total of four matches. The next RLE codeword "1" is selected. Therefore, since level 3 of row 5 is the variant level, then by moving to the next branch (the next sibling value), a match is obtained which completes the processing for that column of image codeword. According to this illustration, three additions were performed, as opposed to eight that would have been performed by the conventional methods, and five matches were found, two "+1", two "−1", and one "+1". The number of matches are accumulated and stored, step 1510.

Therefore, with the hierarchical tree structure method of performing the computation by the calculation engines, a significant reduction in power consumption is achieved. However, on the other, if the same computational burden is placed on the calculation engines, the calculation engines can address display systems having a greater number of pixels thus achieving a substantial increase in resolution.

Still referring to FIG. 13, at step 1512, a determination is made to check if the last RLE codeword was processed. If not, the next RLE codeword is retrieved, step 1514, and the RLE codeword is applied to the retrieved row of the WHT matrix as described above in step 1510. However, if the last RLE codeword was processed, then step 1516 checks to determine when the last row of the WHT matrix was received. If the last row was not received, the next row is received, step 1518, and the process continues to step 1508 which retrieves the first RLE codeword. However, when the last row of the WHT matrix was processed, step 1516, step 1520 determines if the last column of image data was processed. If no, the process continues to step 1502. However, when the last column was received, the flow continues to block 1522 where more data is received and the process can repeat itself. According to the preferred method of the present invention, the hierarchical tree structure is being identified as required to correlate each codeword of the image data with the sibling values which eliminates the need to store the hierarchical tree structure.

Thus, the preferred embodiment of the present invention provides a method and apparatus for driving an actively addressed display in a manner that advantageously minimizes the power consumption of the required calculation engine. By performing calculations using the hidden tree hierarchical method, the preferred embodiment of the present invention substantially reduces the number of calculations and thus substantially reduces the power required to perform active addressing in a portable device. The reduced power compared to conventional drivers for actively addressed displays is a particularly important advantage in portable, battery-powered applications, such as laptop computers, in which long battery life is a highly desirable feature.

In summary, a processing system for addressing an electronic display comprises picture elements (pixels) controlled by a plurality of first and second electrodes. The plurality of first electrodes are controlled by a plurality of periodic first drive signals which have a predetermined number of time slots independent of data being displayed. The plurality of second electrodes are controlled by a plurality of second drive signals responsive of the data being displayed. The processing system comprises a calculating engine for calculating, from data being received, the plurality of second drive signals for one of the plurality of second electrodes for a time slot of the predetermined number of time slots. The calculating engine also calculates one of the plurality of drive signals, for the one of the plurality of second electrodes, as a function of the plurality of periodic first drive signals for the time slot and a selected plurality of pixel values for pixels collectively controlled by the one of the plurality of second electrodes. The calculating engine comprises means for representing the plurality of periodic first drive signals as a sequency-ordered Walsh-Hadamard Transform (WHT) matrix having a number of rows corresponding to the plurality of first electrodes and a number of columns corresponding to the predetermined number of time slots. The calculating engine also comprises means, coupled to the representing means, for identifying a plurality of hierarchical tree structures corresponding to the rows of the WHT matrix representation of the plurality of periodic first drive signals. The identifying means comprises means for determining values at each levels of the hierarchical tree structures of the WHT matrix in response to amplitudes of the plurality of first drive signals corresponding to the one of the predetermined number of time slots; means for generating sub-levels from a first level wherein the means for determining, in response to the means for generating, determines values, being derived from the values at the first level, for the sub-levels being generated; and means, in response to the means for determining, for correlating the values of the levels of the hierarchical tree structures with the data. A controller, coupled to the calculating engine, controls a selection of other pluralities of pixel values for pixels collectively controlled by other corresponding ones of the plurality of second electrodes for calculating additional ones of the plurality of second drive signals for the time slot until the second drive signals for the time slot have been calculated for substantially all pixel values of first frame of data. An encoder, coupled to the calculating engines, encodes the data for a processor which processes the data being encoded and the hierarchical tree structures being identified within the WHT matrix for addressing of the pixels of the electronic display.

What is claimed is:

1. A method for active addressing an electronic display comprising picture elements (pixels) controlled by a plurality of first and second electrodes, the plurality of first electrodes being controlled by a plurality of periodic first drive signals having a predetermined number of time slots independent of data being displayed and the plurality of second electrodes being controlled by a plurality of second drive signals responsive of the data to be displayed, the method comprising the steps of:

(a) receiving successive frames of data to be displayed; and (b) calculating, from each frame of data being received, the plurality of second drive signals for the plurality of second electrodes for a time slot of the predetermined number of time slots, said step of calculating calculates one of the plurality of second drive signals as a function of the plurality of periodic first drive signals for the time slot and a selected plurality of pixel values for pixels collectively controlled by the one of the plurality of second electrodes, said step of calculating further comprising the steps of:

(c) representing the plurality of periodic first drive signals as a sequency-ordered Walsh-Hadamard transform (WHT) matrix having a number of rows corresponding to the plurality of first electrodes and a number of columns corresponding to the predetermined number of time slots;

(d) identifying a plurality of hierarchical tree structures corresponding to the WHT matrix representation of the plurality of periodic first drive signals;

(e) encoding the frame of data being received; and (f) processing the encoded data with the corresponding hierarchical tree structures being identified in the WHT matrix for addressing the pixels of the electronic display.

2. The method according to claim 1 wherein step (b) further comprises the step of:

(g) driving the plurality of second electrodes with the one of the plurality of second drive signals being calculated during the time slot while concurrently driving the plurality of first electrodes with the plurality of periodic first drive signals for the time slot.

3. The method according to claim 2 further comprising the step of:

(h) repeating step (b) using other selected pluralities of pixel values for pixels collectively controlled by other corresponding ones of the plurality of second electrodes for calculating additional ones of the plurality of second drive signals for the time slot until the second drive signals for the time slot have been calculated for substantially all pixel values of the frame of data.

4. The method according to claim 1 wherein the step of identifying identifies the hierarchical tree structures corresponding to the rows of the WHT matrix.

5. The method according to claim 1 wherein the step of identifying further comprises a step of determining for determining values for each level of the hierarchical tree structures of the Walsh-Hadamard Transform matrix in response to amplitudes of the plurality of first drive signals corresponding to one of the predetermined number of time slots.

6. The method according to claim 5 wherein the step of identifying comprises the steps of:

correlating the hierarchical tree structures with the encoded data; and generating a first level and sub-levels therefrom wherein said step of determining, in response to the step of generating, determines values, being derived from the values at the first level, for the sub-levels being generated.

7. A processing system for addressing an electronic display comprising picture elements (pixels) controlled by a plurality of first and second electrodes, the plurality of first electrodes being controlled by a plurality of periodic first drive signals having a predetermined number of time slots independent of data being displayed and the plurality of second electrodes being controlled by a plurality of second drive signals responsive of the data being displayed, the processing system comprising:

calculating engine for calculating from data being received the plurality of second drive signals for one of the plurality of second electrodes for a time slot of the predetermined number of time slots, said calculating engine calculates one of the plurality of drive signals for the one of the plurality of second electrodes as a function of the plurality of periodic first drive signals for the time slot and a selected plurality of pixel values for pixels collectively controlled by the one of the plurality of second electrodes, said calculating engine comprising:

means for representing the plurality of periodic first drive signals as a sequency-ordered Walsh-Hadamard transform (WHT) matrix having a number of rows corresponding to the plurality of first electrodes and a number of columns corresponding to the predetermined number of time slots; and means, coupled to the representing means, for identifying a plurality of hierarchical tree structures corresponding to the WHT matrix representation of the plurality of periodic first drive signals;

means, coupled to the calculating engine, for encoding the data; and a processor, coupled to the encoding means, processes the encoded data and the hierarchical tree structures being identified in the WHT matrix for addressing of the pixels of the electronic display.

8. The processing system according to claim 7 wherein the calculating engine further comprises:

means for driving the plurality of second electrodes with the one of the plurality of second drive signals being calculated during the time slot while said means for driving concurrently drives the plurality of first electrodes with the plurality of periodic first drive signals for the time slot.

9. The processing system according to claim 8 further comprising:

means, coupled to the calculating engine, for controlling a selection of other pluralities of pixel values for pixels collectively controlled by other corresponding ones of the plurality of second electrodes for calculating additional ones of the plurality of second drive signals for the time slot until the second drive signals for the time slot have been calculated for substantially all pixel values of first frame of data.

10. The processing system according to claim 7 wherein the means for identifying further comprises means for determining values at each level of the hierarchical tree structures of the Walsh-Hadamard Transform matrix in response to amplitudes of the plurality of first drive signals corresponding to the one of the predetermined number of time slots.

11. The processing system according to claim 10 wherein the means for identifying identifies the hierarchical tree structures corresponding to the rows of the Walsh-Hadamard Transform matrix, said means for identifying further comprising;

means, in response to said means for determining, for correlating the values of the hierarchical tree structures with the data; and means, coupled to the means for identifying, for generating a first level and sub-levels therefrom wherein said means for determining, in response to said means for generating, determines values, being derived front the values at the first level, for the sub-levels being generated.

12. A processing system for addressing an electronic display comprising picture elements (pixels) controlled by a plurality of first and second electrodes, the plurality of first electrodes being controlled by a plurality of periodic first drive signals having a predetermined number of time slots independent of data being displayed and the plurality of second electrodes being controlled by a plurality of second drive signals responsive of the data being displayed, the processing system comprising:

calculating engine for calculating from data being received the plurality of second drive signals for one of the plurality of second electrodes for a time slot of the predetermined number of time slots, said calculating engine calculates one of the plurality of drive signals for the one of the plurality of second electrodes as a function of the plurality of periodic first drive signals for the time slot and a selected plurality of pixel values for pixels collectively controlled by the one of the plurality of second electrodes, said calculating engine comprising:

means for representing the plurality of periodic first drive signals as a sequency-ordered Walsh-Hadamard Transform (WHT) matrix having a number of rows corresponding to the plurality of first electrodes and a number of columns corresponding to the predetermined number of time slots; and means, coupled to the representing means, for identifying a plurality of hierarchical tree structures corresponding to the rows of the WHT matrix representation of the plurality of periodic first drive signals, said identifying means comprising:

means for determining values at each levels of the hierarchical tree structures of the WHT matrix in response to amplitudes of the plurality of first drive signals corresponding to the one of the predetermined number of time slots;

means for generating a first level and sub-levels therefrom wherein said means for determining, in response to said means for generating, determines values, being derived from the values at the first level, for the sub-levels being generated; and means, in response to said means for determining, for correlating the values of the levels of the hierarchical tree structures with the data;

a controller, coupled to the calculating engine, for controlling a selection of other pluralities of pixel values for pixels collectively controlled by other corresponding ones of the plurality of second electrodes for calculating additional ones of the plurality of second drive signals for the time slot until the second drive signals for the time slot have been calculated for substantially all pixel values of first frame of data; and an encoder, coupled to the calculating engine, encodes the data wherein a processor processes the data being encoded and the hierarchical tree structures being identified within the WHT matrix for addressing of the pixels of the electronic display.

* * * * *